United States Patent [19]

Cowans

[11] 4,294,242

[45] Oct. 13, 1981

[54] SURVIVAL SYSTEM

[75] Inventor: Kenneth W. Cowans, Encino, Calif.

[73] Assignee: Kinergetics, Inc., Tarzana, Calif.

[21] Appl. No.: 135,979

[22] Filed: Mar. 31, 1980

[51] Int. Cl.[3] ..... A62B 7/10

[52] U.S. Cl. ..... 128/201.13; 128/202.19; 128/202.26; 128/204.17; 9/331; 2/2.1 R; 2/69.5

[58] Field of Search ..... 128/201.23, 201.22, 128/201.25, 201.27, 201.29, 202.11, 202.19, 204.17, 202.26, 201.13; 9/11 A, 330, 331, 332; 2/69.5, 2.1 R

[56] References Cited

U.S. PATENT DOCUMENTS

| | | | |
|---|---|---|---|
| 2,324,716 | 7/1943 | Nohl | 128/201.25 |
| 2,618,257 | 11/1952 | Berkman | 9/331 |
| 3,307,540 | 3/1967 | Link | 128/201.29 |
| 3,660,849 | 5/1972 | Jonnes et al. | 2/2.1 R |
| 3,747,598 | 7/1973 | Cowans | 128/201.13 |
| 3,794,030 | 2/1974 | Cotabish et al. | 128/202.26 |
| 3,925,839 | 12/1975 | Smith | 9/331 |
| 4,200,094 | 4/1980 | Gedeon et al. | 128/201.13 |

FOREIGN PATENT DOCUMENTS

| | | | |
|---|---|---|---|
| 795575 | 5/1958 | United Kingdom | 9/11 A |

*Primary Examiner*—Henry J. Recla
*Attorney, Agent, or Firm*—Fraser and Bogucki

[57] ABSTRACT

A passive survival suit for enabling a diver in a confined bell to maintain body temperature for at least a minimum interval in the event of failure of external thermal sources uses a combination of thermal insulation and a coacting breathing gas regenerator and scrubber system. The thermal insulation comprises a combination of a hooded sleeveless vest and a body shell, each of which provide a long heat conduction path length and minimum internal heat convection currents. The regenerator and scrubber system are arranged such that thermal energy in expired breathing gases is stored with high efficiency and used to heat breathing gas during intake, while the carbon dioxide scrubbing reaction is carried out in an optimal warm, moist atmosphere and contributes heat to aid in maintaining the diver's temperature.

13 Claims, 8 Drawing Figures

SURVIVAL SYSTEM

BACKGROUND OF THE INVENTION

With the constant development of deepsea diving technology, divers have worked at increasingly greater depths and now routinely descend to depths as much as 1000 feet below sea level. The diving techniques are based upon the principle of maintaining the divers under pressure for a long period of time, so that they undergo lengthy decompression only at the end of a tour of duty. The principal habitat of the diver during his operational tour is a surface hyperbaric chamber maintained at approximately the pressure that is to be encountered at working depth. When the diver must descend, he is transferred directly into a pressurized diving bell and lowered by a cable system to the work location. At this depth pressures are substantially equalized so that the diver can leave the bell to perform his assigned inspection or maintenance duties. The diver then returns to the bell, which is held pressurized for the return to the surface and the habitat.

In accordance with modern practice, the high pressure breathing gas in the hyperbaric chamber and the bell is predominantly helium and a small percentage of oxygen which provides an oxygen intake equivalent to that at sea level. The high helium content, however, creates a highly heat conductive environment about the diver, from which thermal energy is constantly lost to the cold (typically 0° C. to 5° C.) seawater. Thus the breathing mixture must constantly be heated, or the diver must be in a heated suit, or both. The losses are such that the temperature must be closely regulated or the diver suffers extreme discomfort. For safety and reliability the energy sources for the diving bell are supplied and regulated from the surface.

Diving at such extreme depths is of course hazardous work, not only because of the extreme conditions encountered but also because of the mechanical problems involved in lowering and raising a diving bell over long distances at the end of a cable. The diving bell must be designed to accommodate one or two divers, and must have an adequately pressure-resistant shell without being so large and cumbersome that it cannot be transported without prohibitively costly and massive equipment. Consequently, diving bells typically have little more interior space available than that needed to accommodate the divers. Thus only limited provisions can be made for survival of the divers in the event of catastrophic failure or impairment of a part of the diving system. If a cable breaks, for example, the heating and breathing gas mixture flows from the surface are terminated, and the diving bell descends to the ocean floor. The diving bell incorporates provisions for sealing in the divers under these circumstances, but emergency measures must be undertaken to maintain adequate life support for the divers for a given maximum time, usually 24 hours. This is deemed a sufficient interval for reconnecting a cable to or freeing the bell so that it can be drawn to the surface. In this conjunction, the high pressure, highly heat conductive atmosphere within the diving bell poses extreme hazards even though it provides sufficient breathing gas. The diving bell is large enough to contain spare high pressure breathing gas tanks but cannot contain units or devices that could generate sufficient thermal energy to supply the lost heat. Consequently the temperature in the diving bell rapidly begins to lower to the temperature of the surrounding ocean depths. The pressurized helium conducts heat away from the diver's body so rapidly that it functions as the equivalent of a wind chill factor in the range of −100° C. At such depths, survival is not even conjectural unless some means are provided for maintaining a reasonable body temperature for the diver. Conventional devices and systems that can be used under normal circumstances are wholly inadequate for this purpose. In addition, chemicals that are used to scrub the breathing gas mixture of carbon dioxide do not work well when cold or dry, so that the diver is further endangered in the emergency situation.

SUMMARY OF THE INVENTION

Systems in accordance with the invention utilize an encompassing structure about the diver comprising a combination of an insulation filled integral hood and vest and a complementary insulative body shell into which the diver can move in the event of need. A compartmentalized inflatable mattress filled with insulation and coupled along one side of the shell enables the survival system to be directly in contact with the side of the bell, so that the diver can sit or lay down. The insulative vest and shell provide thick walls which have long internal conduction path lengths and which also eliminate internal heat convection. The thermal energy in the diver's respiration is utilized in conjunction with a $CO_2$ scrubbing system worn by the diver under the insulation. Expired gases from the diver are first passed into a $CO_2$ scrubber canister in which the active chemical is held at a sufficiently high temperature and in a moist condition for efficient operation. The gases are then passed through a high efficiency regenerator that stores both heat and moisture for return to the next inspiratory flow. The exothermic reaction in the canister contributes a substantial heat input to the diver. The temperature of inspired gases can be controlled by use of a variable bypass which mixes in a selectable amount of breathing gas mixture. The entire system is compact and passive, but not so restrictive that the diver cannot perform other short term acts. When an accident occurs, therefore, the diver or divers within a bell can quickly don the survival system and then assume a comfortable position to await completion of the rescue operation. Where space permits, one or more of the divers may be suspended from a point within the diving bell, for which purpose the system can be adapted to incorporate an internal suspension that does not compact the vest or shell.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
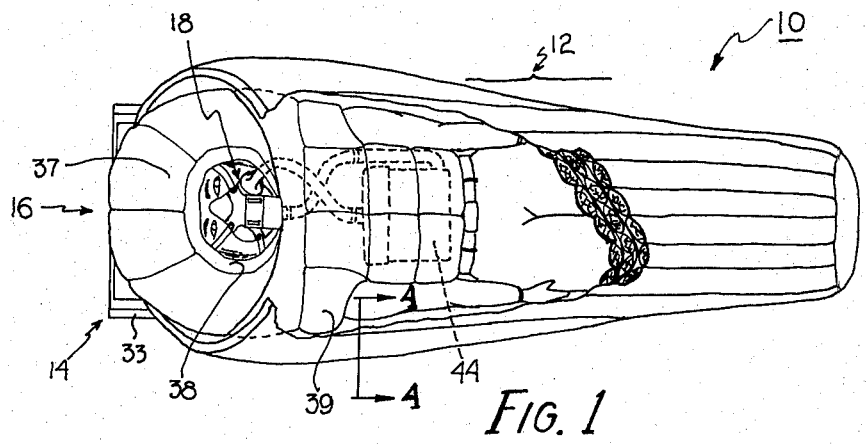
FIG. 1 is a plan view, partially broken away, of a survival system in accordance with the invention.
Figure 2:
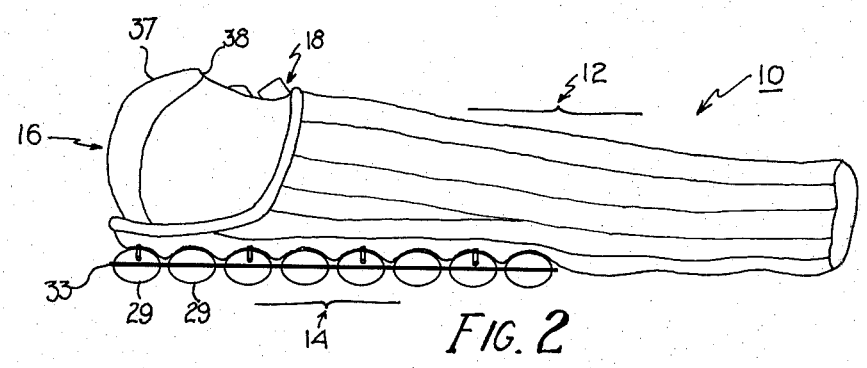
FIG. 2 is a side view of the system of FIG. 1.
Figure 3:
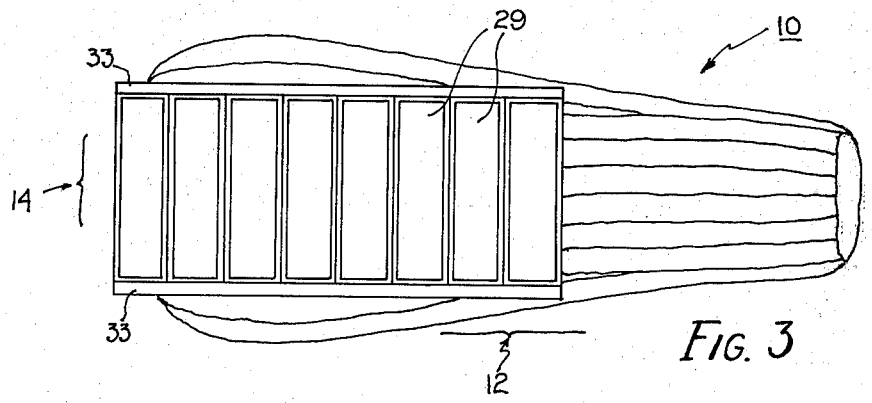
FIG. 3 is a bottom view of the system of FIG. 1.

In accordance with the invention, referring now to FIGS. 1 and 2, a survival suit 10 is shown as worn by a diver lying down within a diving bell. The suit 10 comprises a body shell 12 to which is attached an inflatable segmented insulation filled mattress 14, the mattress being disposed on the posterior side relative to the diver. The survival suit 10 also includes a hooded vest 16 worn by the diver within the shell 12 to cover the diver's head, neck and trunk, and a breathing gas recirculator 18 comprising a face mask worn by the diver, conduits and a scrubber device that are disposed inside the vest 16, as are described hereafter. Thus, as seen in FIGS. 1 to 3, in an emergency the complete survival suit 10 can be put on quickly and easily, by first putting on the breathing gas recirculator 18, slipping on the hooded vest 16 over the head and shoulders, leaving the arms free, and then stepping into the body shell 12 and drawing it up around the body. All of these steps may be accomplished quickly without practice even though the diver may be cold and have less than full freedom of action.

The various parts of the survival suit 10 cooperate to provide a passive survival system for the diver that withstands the heat dissipation problem encountered at depths to approximately 1000 feet. At these great depths, the seawater temperature is in the range of 0° C. to 5° C., and the helium-oxygen breathing mixture is 90%–96% helium (remainder oxygen) creating an extremely effective heat sink which requires very limited heat loss. By this is meant that the heat loss rate from the diver, over a survival interval of at least 24 hours, cannot exceed approximately 80 watts. Investigation of this problem revealed that thermal losses from the body surface and from the expired breathing gases would provide normal losses in excess of 1000 watts. It must also be borne in mind that typical survival clothing, and diver's wetsuits, are readily permeated by the light helium gas, which can thus conduct the heat away at a high rate. Using such conventional approaches, the survival time of a diver at the 1000 ft. depth is at best a few hours, in increasingly great discomfort.

Figure 4:
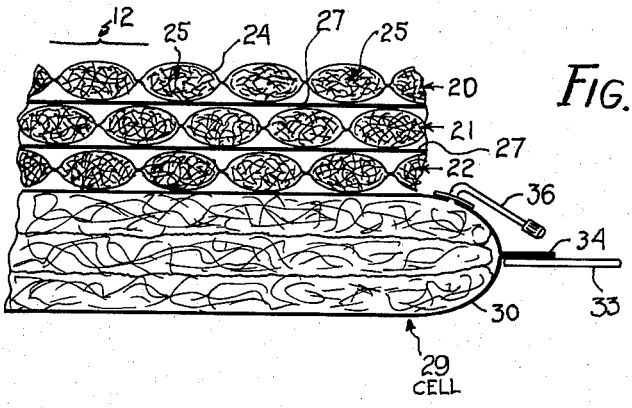
FIG. 4 is an enlarged sectional view of a fragment of an insulative shell taken along the line 4—4 in FIG. 1 and looking in the direction of the appended arrows.

In accordance with the invention, the body shell 12 and hooded vest 16 are each constructed to provide a long heat conduction path length and to eliminate internal convection currents within the insulation. Referring now to FIG. 4, which illustrates the shell 12 but is also applicable to the hooded vest 16, the shell cross-section comprises three successive quilted layers 20, 21, 22 of fibrous insulation each covered by close woven nylon 24 that is conventionally treated to make it water resistant. These quilted layers 20, 21, 22 define a total thickness of 4 to 6 inches, and the internal conductive paths through the insulative fibers are substantially longer. The interiors of the quilted layers are in this example filled with "DACRON HOLLOFIL", a product of du Pont Corp. of Wilmington, Delaware, and comprise long hollow filaments of fine diameter. These filaments 25 are self-supporting and water repellent, and provide an internal permeable matrix with a density such that no significant thermal convection currents exist within the quilted layers. The three layers 20, 21, 22 shown are separated by aluminized film sheets 27 which have their reflective sides facing the diver, and serve to limit radiation losses.

On the posterior side of the body shell 12 relative to the diver, the segmented mattress 14 is made up of a plurality of separate transverse mattress cells 29 having fabric walls 30 that are substantially impermeable to the breathing gas mixture. In this example the walls 30 are of 3 oz. nylon oxford cloth, urethane coated on both sides to 0.003" thickness. The interiors of the cells 29 are filled with polyester fiber insulation 32. Longitudinal webs 33 are joined to the welded side edges 34 of the cells 29 and to the shell 12 to hold the cells 29 in place. Each cell 29 also includes an inflation port 36 welded into the fabric wall 30. The mattress in this example has eight independent cells 29, each 8 inches in diameter by 24 inches long, although it is found that six to ten cells of 6 to 8 inches in diameter by 18 to 24 inches long can be used, depending upon the size and the particular application. These cells can be inflated from a pressurized source (not shown), or can readily be inflated by the diver immediately prior to getting into the shell 12. The inflated mattress 14 provides adequate physical and thermal separation of the body shell 12 and the diver from the cold and thermally conductive walls or interior structure of the diving bell, but permits a substantial degree of movement of the diver within the bell, so that he can assume different positions although he must remain largely passive. The separate cells 29, filled with both gas and insulative fibers insure physical spacing of the shell 12 from any cold surface on which the suit 10 may rest, and limit heat transfer along the length of the mattress 14. In addition the failure of an individual cell 29 does not affect the remainder which remain inflated, and appreciable insulative effects and physical spacing still remain because of the interior fibers.

The hooded vest 16 is designed with like materials and spacing factors, and has a dome portion 37 serving as a special covering for the head and neck, and including a face opening 38, the edges defining the face opening projecting forwardly from the face sufficiently to keep a warm layer of breathing gas in front of the face so as to lower heat loss and temperature differentials in this region. The vest body 39 includes arm openings, leaving the arms free so that the diver can carry on tasks if he must leave the shell 12 for short periods of time.

Figure 6:
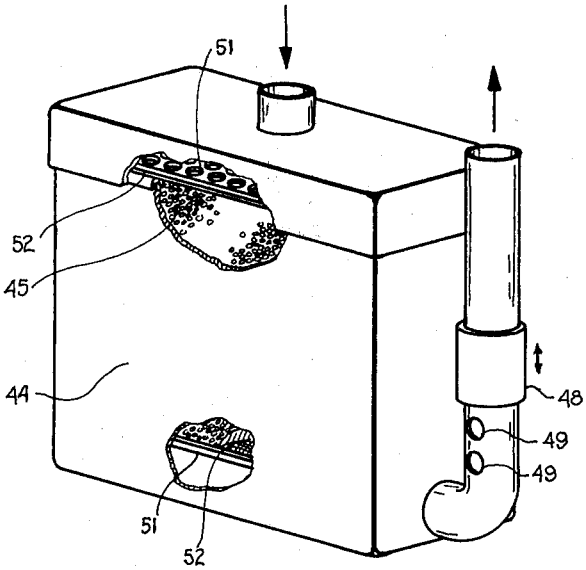
FIG. 6 is a perspective view of a carbon dioxide scrubber canister that may be employed in the device of FIG. 5.

The breathing gas recirculator 18, referring now to FIGS. 5–8, comprises a face mask 40 covering the oral and nasal cavities, and securable in position by elastic straps 41 fitting around the back of the head. A neck strap 43 supports an insulated canister 44 on the chest of the diver, the canister 44 containing a conventional solid chemical 45, such as granular soda sorb or soda lime, for the removal of carbon dioxide from expired gases. The canister 44 shown in FIG. 6 is large enough to hold five pounds of soda sorb, which is adequate for the needed 24-hour interval. Flexible hoses 46, 47 are coupled from the outlet of the face mask 40 to the inlet to the canister 44, and from the canister outlet to the face mask inlet. A bypass sleeve valve 48 is disposed in the inlet to the face mask 40, this valve 48 being slidable by the diver to cover apertures 49 in the conduit, thus providing a controllable ingress of new relatively warm breathing gas from the interior of the suit 10. This control may be used to limit heat buildup within the system at shallower diving depths or to bring the inspired gases to a preferred temperature range. The canister 44 includes, at each end, a perforated plate 51 and overlying screen 52 serving as an end wall for the volume containing the granulated chemical. The plates 51 and screens 52 also are spaced from the end walls of the canister 44, to define manifolds within which intake and outflow gases are distributed. Consequently the breathing gas (expiratory) mixture from the diver is efficiently passed through the soda sorb granules 45 and scrubbed of carbon dioxide.

Figure 7:
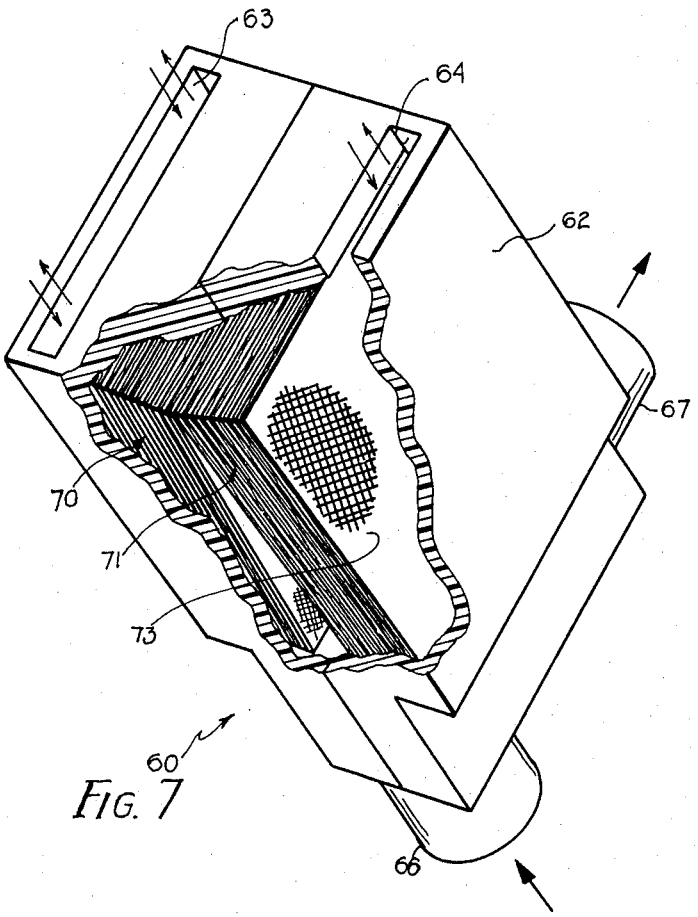
FIG. 7 is an enlarged perspective view, partially broken away, of a regenerator that may be utilized in the device of FIG. 5.
Figure 8:
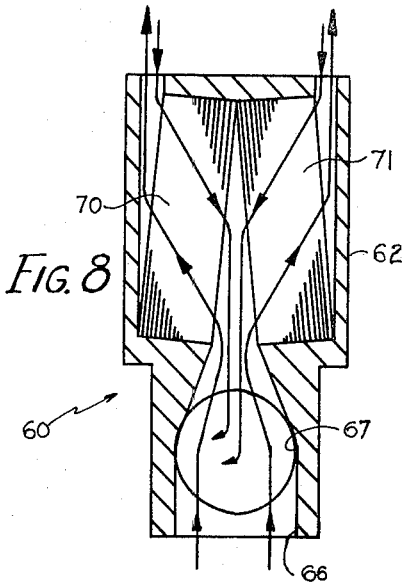
FIG. 8 is a side sectional view of the regenerator of FIG. 7.
Figure 5:
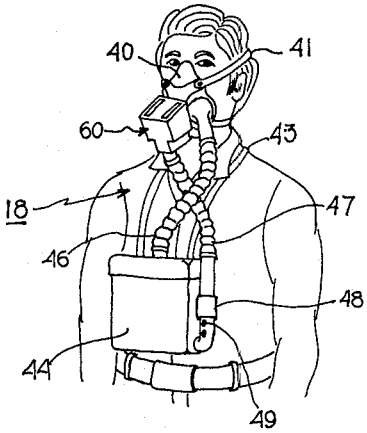
FIG. 5 is a perspective view of a regenerator and scrubber device that may be employed in the system of FIG. 1.

Within the system, the breathing gas recirculator 18 incorporates a mouthpiece regenerator 60 in the flow paths from the canister 44 and breathing gas inlets to the face mask 40. As best seen in FIG. 7, the regenerator 60 has an insulative housing 62 with spaced apart breathing gas ports 63, 64 on one end, an inlet port 66 for receiving expired gases on the other end, and an outlet port 67 for feeding out inspired gases to the diver at one side. Each of the flows passes through the regenerator structure, which here advantageously comprises two rectangular heat exchanger blocks 70, 71 forming an intersecting angle with the point of intersection being midway between and adjacent to the cold gas ports 63, 64. Each block 70, 71 is made up of multiple layers 73 (seventy-five layers in this example) of 100 mesh stainless steel, forming a regenerative heat exchanger structure that operates with 95% efficiency in retaining both heat and moisture. Furthermore, the mesh layers 73 are disposed at a bias of 22° relative to the rectangular outline, with the angle of bias being reversed with each alternate layer. This disposition limits heat transfer through the layers. As best seen in FIG. 8, expired gases thus, after passing through the scrubber canister 44, are directed from the inlet port 66 into the space between the blocks 70, 71, then through the blocks and to the breathing gas ports 63, 64 for mixture with the breathing gas in the bell. Cold inspired gases are drawn through the gas ports 63, 64, then through the regenerator blocks 70, 71 in the opposite direction and then out through the outlet port 67 to the diver. Heat and moisture retained from expired flow in an exhalation are given up to the inspired flow on the next inhalation, so that the diver's system need not constantly make up a significant temperature differential.

This entirely passive system operates in a unique and cooperative fashion to conserve thermal energy in the cold hyperbaric helium/oxygen environment of a stranded diving bell. The inflated mattress 14, and its insulation material, maintains the desired degree of insulative and physical spacing between the diver's body and any contacting surface despite the inevitable compression occurring under the diver's weight. The hooded vest 16 and body shell 12 protect all vital areas, with double protection for the diver's trunk and more than adequate insulation for the head and neck.

The encompassing insulation of the vest 16 and shell 12 also maintain the canister 44 at a temperature approaching that of body temperature, and the expired breathing mixture contains sufficient moisture to facilitate the scrubbing reaction which takes place within the canister. The reaction itself is exothermic, giving off approximately 20 watts of heat to contribute to maintenance of diver temperature. Inspired gases from the bell environment are heated in the regenerator 60, easing discomfort for the diver and just as importantly substantially reducing the amount of heat energy required of the diver. With this system, the conduction heat load is reduced to a level of about 50 watts in the highly pressurized helium/oxygen atmosphere at 0° C. ambient.

With this system, the diver can quickly don the suit in the event of an emergency, the thereafter remain passive, sitting, laying down or standing up as determined by space and comfort considerations. The space limitations in a two-man diving bell are generally such that divers will be cramped and cannot be free of the walls of the bell. However with this system, the available space can best be utilized, resting the mattress 14 against the bell floor or walls as necessary. The divers nonetheless remain free to work their arms outside the shell 12 to make necessary adjustments or replacements, or they can operate with a limited amount of thermal protection with the hooded vest 16 both for themselves and the breathing gas recirculator 18 if they must leave the shell 12 for any reason.

Where space permits, a longer survival time may be provided by using an internal harness, in the manner of a parachute harness mounted on the diver, or an internal harness within the body shell 12 for suspending the entire structure. The suspension aids in securing the passivity of the diver and in preventing dissipation of thermal energy through the diving bell structure.

Tests run in cold hyperbaric helium/oxygen environments have demonstrated that with proper operation this system provides the desired 24 hours survival time at depths to 1000 feet. The conditions involved are so critical, however, and the chill factor so extreme, that failure to use all parts of the system as intended results in a lowering of the body temperature to unacceptable levels. The diver, for example, may not feel discomfort for a period of time in discontinuing the use of the regenerator, but rectal, head and foot temperatures gradually decrease over a time span less than one hour, and reach dangerously low levels thereafter. If the diver does not utilize a protective system, he is able to withstand the cold only for a short time span, of the order of two hours or less.

Although various arrangements and modifications have been discussed above, it will be appreciated that the invention is not limited thereto but encompasses all forms and variations falling within the scope of the appended claims.

What is claimed is:

1. A passive system for reducing the thermal energy losses of a person in a confined cold hyperbaric environment, comprising:

insulative means for encompassing the person at all but the face region, the insulative means having at least four inches of conductive path length and comprising interior fibrous insulation providing minimal interior convection currents;

carbon dioxide scrubber means disposed within the insulative means and coupled to receive expiratory flows from the person, such that the heat and moisture in the expiratory flows together with the encompassing insulative means establish an efficient exothermic reaction contributing heat to the person; and regenerator means coupled to receive expiratory flow from the scrubber means and communicating with the environment to provide inspiratory flows from said scrubber means therethrough to the person, the regenerator means being configured to couple expiratory flows to the environment while storing heat and moisture contained therein, and to give up the heat and moisture to inspiratory flows.

2. The invention as set forth in claim 1 above, wherein the insulative means comprises a plurality of mattress cells disposed along one side thereof for contact with a cold supporting surface.

3. The invention as set forth in claim 2 above, wherein the insulative means further comprises a hooded vest having a face and arm openings, and a body shell, and wherein the mattress cells include interior fiber insulation and means for inflating the cells.

4. The invention as set forth in claim 3 above, wherein the system further includes bypass valve means in the flow path from the scrubber means to the regenerator means, the bypass valve means providing a selectable flow rate of gas from the environment to be mixed with the flow from the scrubber means.

5. The invention as set forth in claim 4 above, wherein the regenerator means comprises an insulative housing having at least one opening to the environment, and an internal regenerative heat exchanger comprising a plurality of layers of fine metal mesh.

6. A system for providing passive thermal energy conservation for a diver in a helium/oxygen breathing gas environment at pressures corresponding to substantial depths below sea level, comprising:

an insulated hooded vest covering the head and trunk of the diver;

a generally cylindrical insulated body shell having a closed end, for receiving a diver and encompassing the diver with overlap about the hooded vest and along the upper body of the diver, the shell including an array of inflatable, insulation filled mattress cells on one side thereof, the shell and hooded vest each having wall thicknesses in excess of four inches thick of multifilament synthetic fiber insulation providing substantially minimal interior thermal convection;

a carbon dioxide extraction system worn by the diver and including a face mask adapted to cover the oral and nasal cavities of the diver, canister means disposed within the hooded vest, and conduit means coupled to flow expired gases from the face mask through the canister means and back to the face mask, said canister means being activated passively by the moisture content in the expired gases to initiate an exothermic scrubbing reaction and being maintained at an adequate operating temperature by body heat within the hooded vest and shell; and mouthpiece regenerator means coupled to the face mask in the path of expired gases flowing from the canister means and adapted to store thermal energy therefrom, said regenerator means including flow path means for conducting expired gases from said canister means to the environment and inspired gases from the environment into said facemask wherein thermal energy stored during an exhalation is transferred to breathing gas inspired by the diver on a succeeding inhalation.

7. The invention as set forth in claim 6 above, wherein said air mattress cells comprise a plurality of individual cells separated from each other and each having walls substantially nonpermeable to the breathing gas, and means for inflating the cells individually, and wherein the carbon dioxide extraction system includes valve means coupled to the conduits for flowing a controllable amount of breathing gas from within the hooded vest and shell into the expired flow to control the temperature thereof.

8. The invention as set forth in claim 7 above, wherein the wall thicknesses are in the range of 4 to 6 inches and the mouthpiece regenerator means comprises multiple layers of metal mesh providing approximately 95% efficiency in retaining thermal energy and moisture in the expired gases.

9. The invention as set forth in claim 8 above, wherein the canister means comprises a housing, apertured means defining a central containment volume and end manifolds, means defining an inlet and an outlet coupling the end manifolds to the different conduits coupled to the face mask, and granular carbon dioxide absorbing material within the central containment volume, whereby the expired gas flow is distributed through the granular material.

10. The invention as set forth in claim 8 above, wherein the regenerator means comprises a pair of rectangular blocks defined by multiple mesh layers and defining an intersecting angle, and means for directing expired and inspired flow through the blocks in opposite directions.

11. A breathing gas treatment system for conserving the heat energy in expired gases from an individual, comprising:

a thermal and moisture regenerator including first flow path means for passing expired flows from a person, through said regenerator and to the environment and second flow path means for passing inspired flows from the environment, through the regenerator and to the person, said regenerator including two spaced apart assemblies of layers of fine metal mesh and being disposed in said first and second flow path means to direct expired and inspired flows in opposite directions through the assemblies; and carbon dioxide extraction means coupled in said first flow path means upstream of said regenerator for receiving expired gases and including chemical means disposed therein for absorbing carbon dioxide and which utilizes the heat and moisture content in the expired gases to establish an exothermic reaction whereby the heat and moisture in said expired gases flowing from said chamical means are stored in said regenerator during an exhalation and transferred to inspired gases during an inhalation.

12. The invention as set forth in claim 11 above, wherein the regenerator assemblies each comprise approximately 75 layers of 100 mesh stainless steel screen.

13. The invention as set forth in claim 12 above, wherein the regenerator comprises an insulative body having a pair of spaced apart flow openings in one wall thereof, the assemblies comprise a pair of spaced apart rectangular blocks angled to intersect at the wall containing the flow openings, and the insulative body further includes inlet and outlet port means communicating with the opening between the spaced apart ends of the rectangular blocks.

* * * * *

UNITED STATES PATENT AND TRADEMARK OFFICE

CERTIFICATE OF CORRECTION

PATENT NO. : 4,294,242

DATED : October 13, 1981

INVENTOR(S) : Kenneth W. Cowans

It is certified that error appears in the above-identified patent and that said Letters Patent are hereby corrected as shown below:

Column 6, line 2, after "emergency," and before "thereafter", strike "the" and substitute --and--; line 62, before "therethrough", strike "from said scrubber means"; line 64, after "flows" and before "to", insert --from said scrubber means--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*